United States Patent [19]

Lesch

[11] Patent Number: 4,630,428

[45] Date of Patent: Dec. 23, 1986

[54] METHOD AND APPARATUS FOR PLACEMENT OF SMALL ARTICLES, SUCH AS CANDIES OR CHOCOLATES IN PREDETERMINED POSITIONS IN A RECEIVER

[75] Inventor: Hans-Bernd Lesch, Munich, Fed. Rep. of Germany

[73] Assignee: Sapal Societe Anonyme des Plieuses Automatiques, Ecublens, Switzerland

[21] Appl. No.: 718,862

[22] Filed: Apr. 2, 1985

[30] Foreign Application Priority Data

Apr. 28, 1984 [EP] European Pat. Off. ..... 84104796

[51] Int. Cl.[4] ..... B65B 59/00

[52] U.S. Cl. ..... 53/474; 53/246; 53/251; 53/240; 53/238

[58] Field of Search ..... 53/154, 155, 247, 248, 53/474, 238, 240, 246, 249, 251, 534, 539

[56] References Cited

U.S. PATENT DOCUMENTS

| | | | |
|---|---|---|---|
| 3,191,357 | 6/1965 | Hawley et al. . | |
| 3,225,513 | 12/1965 | Ehe | 53/539 X |
| 3,456,424 | 7/1969 | Thurston et al. | 53/154 |
| 3,735,556 | 5/1973 | Dille et al. | 53/247 X |
| 3,981,394 | 9/1976 | Slathar et al. | 53/154 X |
| 4,043,442 | 8/1977 | Greenwell et al. | 53/251 X |
| 4,055,943 | 11/1977 | Reichert et al. | 53/539 X |
| 4,246,740 | 1/1981 | Chenevard | 53/247 X |

FOREIGN PATENT DOCUMENTS 1956246 11/1970 Fed. Rep. of Germany .

*Primary Examiner*—John Sipos
*Assistant Examiner*—Steven P. Weihrouch
*Attorney, Agent, or Firm*—Frishauf, Holtz, Goodman & Woodward

[57] ABSTRACT

Small articles, particularly chocolate and candies, are placed in predetermined positions in a receiver, such as deep-drawn compartmented boxes. The articles (1) are assigned coordinate positions (90) in the receiver, in X-Y coordinate system. The receivers (2) are transported at a predetermined, preferably speed passed an insertion station, where the articles are moved in a predetermined insertion path (47) transversely to the X direction of movement of the receivers. The movement of the articles and the transport speed of the receivers are synchronized. To permit placement of the articles at selected X coordinate positions, a temporal phase shift is introduced between the movement of the articles in the insertion path and the transport speed of the receivers, for example by changing the position of a cross gear in a differential. The insertion path in the Y direction is predetermined by guide tracks (14, 15) which is shifted bodily in the Y direction by a positioning motor (60, 61). The insertion units can be made narrow to place a number of them adjacent the transport path.

17 Claims, 8 Drawing Figures

METHOD AND APPARATUS FOR PLACEMENT OF SMALL ARTICLES, SUCH AS CANDIES OR CHOCOLATES IN PREDETERMINED POSITIONS IN A RECEIVER

The present invention relates to a method and apparatus for placement of small articles such as candies, chocolates and the like in predetermined positions in a receiver, in specific receiving positions in packages and/or display cartons.

Background

Various arrangements and methods have been proposed for placing small articles, for example, candy, chocolates and the like in predetermined positions in receiving containers, for example molded display and/or shipping and packaging compartments adapted for placement, or already placed in suitable cartons or boxes. Each one of the articles is allocated a coordinate position in a X-Y coordinate system within the receiver, so that, for example, different types of candies can be placed in predetermined locations, which can be identified on a display sheet or diagram so that the customer can select the particular type of candy and/or chocolate or filling desired from the position of the particular item in the box. The receiving box is transported by a transport mechanism in one of the coordinate directions, typically the X direction at a predetermined, usually uniform speed. Spacing of the boxes is maintained by spacing strips or the like. At an insertion station, the articles are held and then cyclically moved in a predetermined path, transversely to the coordinate direction of movement of the container; that is, the articles are then moved in a path which includes the Y coordinate over the receiver. The insertion movement of the articles is synchronized with the predetermined transport speed of the receiver, so that the articles can be released into the receiver at the predetermined Y coordinate direction.

An apparatus that operates according to the known method having these features is known from U.S. Pat. No. 3,191,357. It serves to place articles of candy, preferably located in paper cups, into boxes that are to be sold, the interior of which is divided, by means of an insert having walls that intersect at right angles, into compartments of rectangular cross section disposed in rows. These boxes are moved by a continuously driven conveyor, which has carriers disposed at fixed intervals, through a placement, or insertion station, in which a plurality of placement means are disposed beside one another on both sides of the conveyor. Each of these placement means has an elongated, closed path, which is located in a horizontal plane parallel to the conveyor and along which the articles, which are delivered singly, are moved by placement elements. The placement elements are embodied in the form of a resilient alignment element and an associated pusher. The closed path is positioned with a straight portion of the path above the conveyor and parallel to the transporting direction, in such a manner that the articles moved along this portion of the path in the same direction as the conveyor are each located recisely above their respective coordinate positions at the time when the pusher comes into action.

The elongated paths of the various placement means along which the articles to be placed must be transported individually necessitate a large amount of space; as a result, for a box containing a good assortment of candy, the placement station must include a correspondingly high number of placement means and must accordingly have a considerable length. Even from the standpoint of the workspace area then required, this is quite expensive. Aside from that, this system does not permit the placement of the various articles of candy in arbitrary coordinate positions in the boxes. Every change in the coordinate position assigned to a placement means, for instance to insert candy of a different size, means that the closed path of the placement means has to be shifted relative to the conveyor in the X or the Y direction, which can be accomplished only by shifting the machine frame of the entire placement means on its base accordingly and then resecuring it. This is difficult and costly.

Another apparatus for placing candy or the like into package inserts (see German Pat. No. 1,956,246) does enable the placement of articles of candy in any arbitrary position in a package insert without having to change the position of the entire apparatus relative to the associated conveyors for the package inserts. Here again, however, relatively time-consuming conversion operations must be performed. In this apparatus, the candies are conveyed in rows, aligned by means of the parallel conveyor paths, in the Y direction above the package inserts which are transported in the X direction, until the candies encounter adjustable stops, the adjusted position of which corresponds to the Y coordinate of the intended placement position. From among the parallel rows thus lined up together, associated gripper elements, which are movable in parallel paths extending in the X direction, remove individual articles and place them at the appropriate position of the appropriate package insert. In order to approach placement positions having different coordinates, not only the adjusted positions of the stops of the parallel supply paths for the articles of candy, but the spacing of these supply paths in the X direction must be changed, and the grippers, mounted on a common pivot shaft, must be adjusted in the X and Y directions. Since the grippers and their drive mechanism in the X direction are disposed laterally beside the supply paths or tracks, the entire apparatus furthermore occupies a considerable amount of space.

The Invention

It is an object to provide a method and an apparatus which enable the inexpensive, automatic placement of articles, in particular candies, at freely selectable positions in the receiving containers such as package inserts traveling past them and also make it possible to change the placement position, for example from one receiving container to the next, in a freely programmable manner.

Briefly, the placement movement is temporally phase shifted with respect to the transporting or conveying movement by a fixed value which is dependent on the X coordinate of an optionally approachable placement position; or, in other words, the timing of the insertion movement of the articles is selectively controlled with respect to movement of the receptacle for the articles past an insertion position.

It is suitable for the receiving containers to be conveyed at a constant speed, so that forces of retardation or acceleration do not arise. The placement movement may be effected along a path located in a vertical plane and extending at right angles to the X direction; as a result, the lateral space required in the X direction is reduced to a minimum. A great number of such placement movements can thus be executed beside one another within a small space.

In a preferred embodiment, the placement movement is effected over a constant length in the Y direction, and the length of the insertion path is shifted in the Y direction, in accordance with the Y coordinate of the placement position that is being approached.

In order to assure quite accurate positional insertion of the articles at the intended locations, especially in the event of a high conveyor speed, it is advantageous to impart a supplementary movement component in the X direction to the articles, at least in the last phase of movement prior to their placement.

The method has the advantage that a freely programmable, optional approach to arbitrary placement locations in the continuously moved receivers is possible, without necessitating an interruption in operation.

In accordance with a feature of the invention, an apparatus is provided for generating a temporal phase shift between the drive mechanisms of the placement means and the conveyor means in accordance with the X coordinate of an optionally approachable placement location.

To this end, the drive mechanisms or apparatus of the placement and conveyor means can be coupled with one another via an angularly adjustable coupling, which in a preferred embodiment is embodied by a differential gear into which a supplementary rotational movement can be introduced by means of an associated positioning means. By a simple superimposed control of the positioning means, any arbitrary placement position can thus be optionally approached in the X direction at a location of the receivers, traveling past the placement means, which varies from one operating cycle to the next. The superimposed control of the positioning means does not require the system to be brought to a stop, so that it is readily possible to produce various package patterns, for instance supplying articles to package inserts of various lengths and having various compartment patterns. The operating movement of the placement and conveyor means is independent of the adjusting movement executed by the positioning, or shift control, means.

In a preferred embodiment, the placement means has a placement head carrying the movable placement elements. The placement head is supported on stationary guide paths such that it is adjustable in the Y direction, and it is coupled with a positioning element effecting the adjustment in accordance with the Y coordinate of the optionally approached placement position. By means of freely programmable superimposed control of the positioning element, every placement position, having an arbitrary Y coordinate, can be optionally approached.

The placement elements, embodied as grippers or suction pickup elements, can be supported on the placement head by means of a cam control linkage such that they are movable along a predetermined path, which is located in a vertical plane extending in the Y direction. As a result, the structure of the overall placement means becomes particularly narrow, and it may for instance be embodied in the form of a narrow unit the width of which is less than the length of a receiver; in that case, a number of these narrow units can be disposed beside one another on both sides of the conveyor means in the placement station, thereby attaining a minimal insertion station length.

Since the movable placement elements driven by the cam control linkage always execute the same placement movement regardless of the particular placement position approached, it is appropriate for the means which supplies the articles to be coupled with the placement head in such a manner that the supply means is adjustable in common with the placement head, so that the articles that have been supplied can always be received at the same intervals by the placement elements. To this end, the supply means can have a conveyor which brings the articles in rows to a receiving location that has a fixed spatial association with the movement path of the placement elements.

The conveyor means which moves the receiving containers through the insertion station, spaced apart from one another at fixed intervals, may be in the form of a belt or chain conconveyor having drivers disposed at fixed intervals for the the receiving containers, or receivers.

However, the arrangement may instead be such that the conveyor means has a smooth conveyor belt, driven continuously if that is desired, on which the receivers are disposed in succession in rows, and with which, at least on one side, an endless, revolving movement control means is associated in the vicinity of the insertion station. This movement control means has drivers disposed at equal intervals and engaging the receivers from the side and is guided with one run intermittently parallel to the conveyor or supply track, its drive being synchronized with the drive of the placement means and the movement control means being driven with a relative speed with respect to the conveyor track.

In this manner, the receivers are pressed against the drivers, as they travel through the insertion station, with a frictional force deriving from the relative movement with respect to the conveyor track. As a result, the receivers travel through the insertion station at exactly equal intervals and thus in exactly identical operating cycles and are aligned perfectly at the same time. The intervals or spacing between the drivers corresponds to the maximum value of the length of the receivers being moved; regardless of their length, the receivers always rest with one side flush against the drivers, so that the placement positions as well are approached at the correct coordinates.

With receivers in the form of package inserts, the drivers are advantageously disposed at the height of the side walls of the shaped depressions provided for receiving the candies. The package inserts, produced by deep drawing of plastic foil material, are in fact, as experience has shown, frequently dimensionally accurate only in the vicinity of the depressions generated in the deep drawing molds. If the drivers engage the side walls of the depressions, accurate, positionally correct movement of the package inserts is always assured.

DRAWING

DETAILED DESCRIPTION

Figure 1:
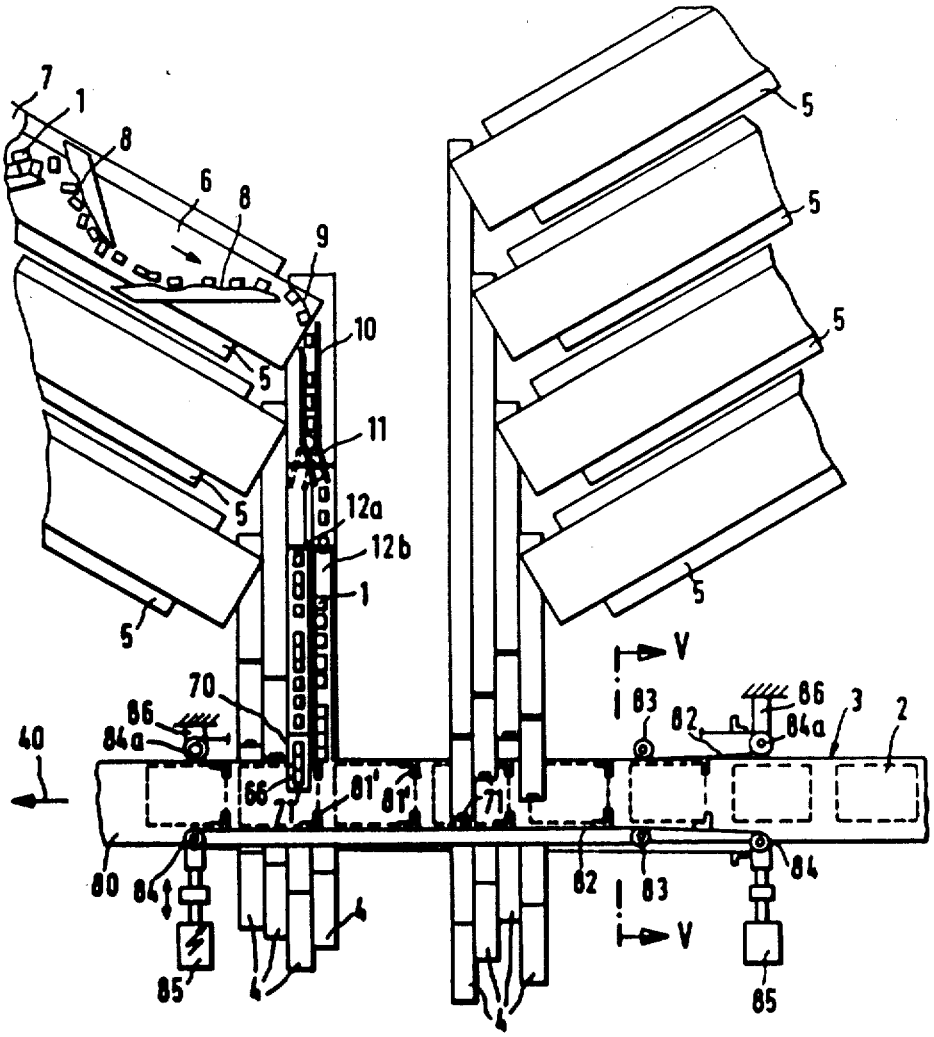
FIG. 1 is a schematic illustration in top view of an insertion station with a placement means according to the invention.
Figure 2:
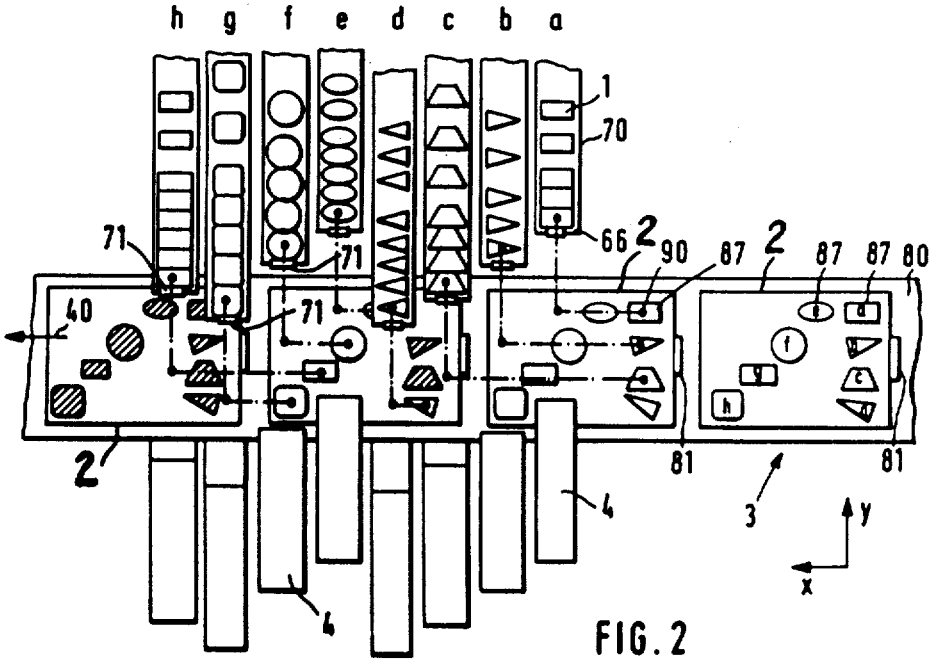
FIG. 2 is a fragmentary schematic top view of the placement means of the insertion station which has been modified in terms of the conveyor means as compared with the insertion station of FIG. 1.

In FIGS. 1, 2, an insertion station is shown, in which articles 1 in the form of pieces of candy, chocolates or the like are to be inserted into package inserts, the outlines of which are shown at 2, for boxes that are to be sold. The package inserts 2, generally embodying receivers for the candy, are moved to and transported through the insertion station in a row, one after another, in the X direction indicated by the arrow 40 by a conveyor means 3. In the insertion station, eight placement means 4 are disposed laterally beside the conveyor means 3, and supply means show individually or in pairs at 5 (FIG. 1) for supplying the articles 1 are associated with these placement means 4. The placement means 4 are embodied as narrow units, the width of which is less than the length of a package insert 2. Each placement means 4 places a specific type of candy 1 into the package inserts 2 at a selected placement location, as the package inserts are moved continuously and in succession through the insertion station by the conveyor means 3.

Each supply means 5 has a conveyor belt 6 revolving in the direction of the arrow, and the articles 1 are placed at random onto this belt at 7 and are conveyed by the conveyor belt 6 toward stop panels 8 protruding into the belt movement path, whereupon the articles 1 are aligned in a known manner as they slide along the panels 8. From the conveyor belt 6, the articles 1, guided by a deflection element 9, move singly and in correct alignment into a supply chute or channel 10, which merges with a shunt 11, which distributes the individual articles 1 as needed via a feed chute or channel 12*a* or 12*b* to one of the two placement means 4 supplied by the supply means 5.

In the group of four placement means 4 shown on the right in FIG. 1, each placement means 4 is disposed in alternation with its own supply means 5.

Figure 4:
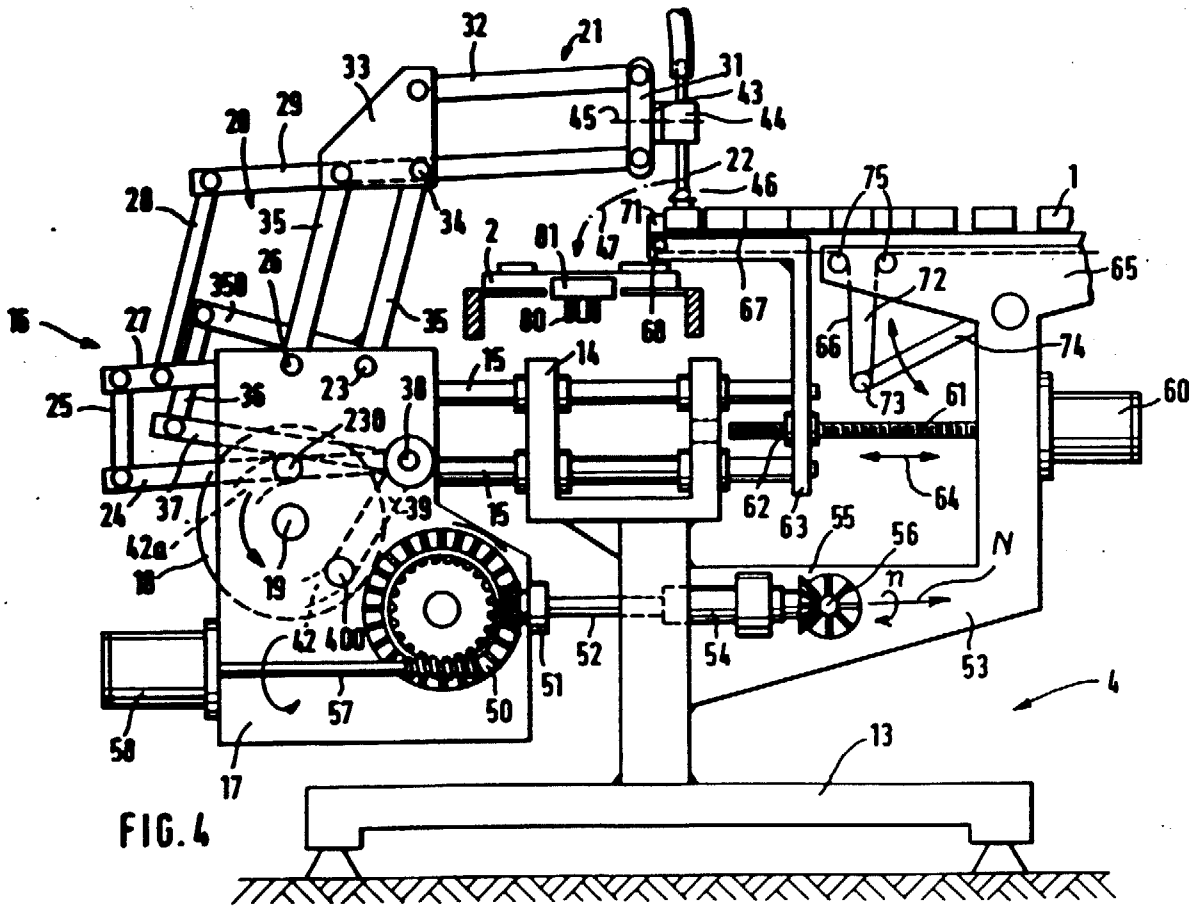
FIG. 4 is a side view of an apparatus similar to FIG. 2.

The structure of a placement means 4 of this kind is shown particularly in FIG. 4:

The placement means 4 has a base 13, with which a bearing block 14 is rigidly connected, in which two parallel guide rods 15 are supported such that they are longitudinally displaceable in a horizontal plane. The two guide rods 15 bear a placement head 16, which has a housing 17 in which a disc cam 18 is rotatably supported on a shaft 19. An insertion arm 21 is movably supported on the housing 17 by means of a lever mechanism or linkage 20 and is joined at its free front end to a suction pickup or gripper element 22' forming one placement element.

The linkage 20 has a lever 24 pivotably supported at 38 in the housing 17; the lever 24 is driven via a cam follower roller 230 engaging a cam track 42*a* of the disc cam 28 and at its other end is articulated via a link 25 to a second lever 27, which is pivotably supported on the housing 17 at 23. Via a coupling member 28, a third lever 29, embodying part of the insertion arm 21, is articulatedly connected to the second lever 27; at its other end, the third lever 29 is articulatedly connected via a connecting member 31 to a parallel guide lever 32, which is articulated in turn, at its other end, on a connecting element 33, which is supported both on the third lever 29 and 34 and on parallel coupling members 35.

A lever 350, which is coupled to a lever 37 via a link 36 articulated onto the end of the lever 350, is welded to one of the coupling members 35. The lever 37 is supported on the articulation point 38 and rigidly joined to a drive lever 39, which on its free end carries a roller 400 which engages a cam track 42 of the disc cam 18. The cam tracks 42, 42*a* are disposed on opposite sides of the disc cam 18.

A bearing element 43 is secured to the front of the connecting member 31, and a holder 44 in which the suction or gripper element 22 is retained is supported on the bearing element 43, being pivotable to a limited extent about a horizontal shift indicated at 45.

Operation of supply mechanism

The linkage 20 is designed such that upon a rotation of the cam disc 18, the head of the suction or gripper element 22 travels through a movement path indicated by dashed lines at 47 and located in a vertical plane, in which the head executes a cyclical insertion movement. In the course of this insertion movement, the head 46 is first raised and then moved to the left, as seen in FIG. 4, and simultaneously lowered, whereupon it is raised once again, optionally after a brief period at rest there, and returned to the position shown in FIG. 4.

The drive of the disc cam 18 is effected via a differential gear 50, disposed in the housing 17, beginning at a drive shaft 52 also rotatably supported, in this case at 51, on the housing 17. The driver shaft 52 has splines, via which it is coupled in a rotationally fixed but longitudinally displaceable manner to a hollow shaft 54 rotatably supported on a beam 53 of the base 13. The hollow shaft 54 is in turn rigidly coupled via a bevel gear 55 and a shaft 56 with the drive means of the conveyor means 3 (FIGS. 1, 2), as symboliically shown in FIG. 4 by rotation arrow n and arrow N leading to the conveyor means 3.

The differential gear 50 is coupled via a shaft 57 to a positioning motor 58 mounted on the housing 17, which makes it possible to introduce a supplementary rotational movement into the differential gear, by means of which the differential pinion shaft of the differential gear is rotated, causing the disc cam 18 and the drive shaft 52 to be rotated counter to one another by a predetermined value in terms of their respective angular positions.

Instead of the differential gear 50, an angularly adjustable coupling of a different design could also be used, permitting this adjustment of the relative angular position of the disc cam 18 and the drive shaft 56.

A second positioning motor 60 is flanged to the substantially L-shaped beam 53 and drives a threaded spindle 61, which via a spindle nut 62 inserted into an end plate 63 connected at the end to the guide rods 15 makes it possible to move the insertion head 16 linearly back and forth in the direction of the guide embodied by the guide rods 15, as indicated by the double-headed arrow 64.

Disposed on the beam 53 is a table 65, on which an endless supply conveyor belt 66 is guided, extending across an adjoining table part 67 of the L-shaped end plate 63, on which it is guided at its end, at 68, via a deflection roller. The supply conveyor belt 66 is part of a supply conveyor 70 (FIG. 1) adjoining the feed chute 12*a* or 12*b* in FIG. 1; by means of this supply conveyor 70, the individual articles 1 are brought to this point and stacked together against a stop 71 disposed at the end of the table part 67.

Since the stop 71 and the deflection roller 68 execute a longitudinal displacement along with the longitudinal displacement of the placement head 16 effected by the positioning motor 60, the supply conveyor belt 66 is guided in a loop 72 via a length-compensating arrangement, which has a spring-loaded or weighted compensating swing 74 pivotably supported on the beam 53. The swing 74 has a deflection roller 73 on its end and is associated with two deflection rollers 75 attached to the frame.

The conveyor means 3 has an endless supply track 80 (FIGS. 1, 2, 4) revolving at a constant speed, in the form of a conveyor belt or conveyor chain, which in the embodiment of FIG. 2 has drivers 81 disposed at fixed, uniform intervals.

In the embodiment according to FIG. 1, the supply track 80 is merely a smooth supply track, on both sides of which there are two endless conveyor belts 82 located in the vicinity of the insertion station and deflected about vertical axes. These belts 82 are oriented with one belt run parallel to the supply track 80, and they carry the drivers 81' which protrude laterally beyond the supply track 80 and are again disposed at equal intervals. Viewed in the movement direction 40, a conveyor belt 82 is laterally supported at 83 in front of the insertion station via adjustably supported support rollers, spaced apart by a distance dictated by the width of the package inserts 2, while its deflection rollers 84 on the end are adjustable via a shift control means 85 at right angles to the movement direction 40 in common with the support rollers 83 and the deflection rollers 84*a*, so that the conveyor belts 82 can be automatically adapted to package inserts 2 of varying widths.

The supply track 80 travels somewhat more slowly than the conveyor belts 82, which with their drive means are compulsorily coupled via the shaft 56 (FIG. 4) to the drive of the placement means 4. Because of the frictional forces engaging the bottom of the package inserts 2, it is thereby assured that the package inserts 2 will rest accurately with their backs against the drivers 81'.

Figure 5:
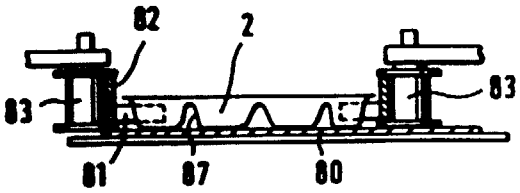
FIG. 5 is a sectional view along the line V—V of FIG. 1, of the conveyor means of the insertion station of FIG. 1, also on a different scale.

Furthermore, as shown in FIG. 5, the drivers 81' are disposed on the conveyor belts 82 in such a manner that they engage the side walls of the depressions 87 of the package inserts, that is, at locations in which, because of the deep-drawing mold used during manufacture, high dimensional accuracy of the package inserts 2 is assured.

Figure 3:
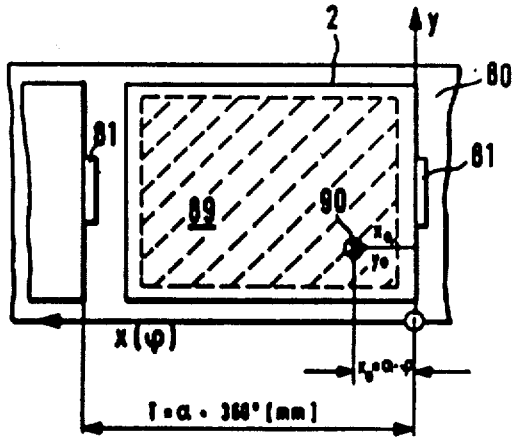
FIG. 3 is a fragmentary top view of the conveyor means of the insertion station of FIG. 2, showing a receiver, on a different scale.

Operation of insertion mechanism (with reference to FIG. 3):

The articles 1 are inserted into the package inserts 2 in the following manner:

Each of the package inserts 2 supplied by the conveyor means 3 is assigned a coordinate system, moved in common with the package insert 2, in the manner shown in FIG. 3. The longitudinal, or X direction of this coordinate system extends in the movement direction of arrow 40 (FIG. 1) parallel to the supply track 80, while the transverse, or Y direction extends at right angles to the X direction and the longitudinal extension of the supply track 80. The typically rectangular package inserts 2, each resting with its back against a driver 81 or 81' (FIGS. 1, 2) are aligned on the supply track 80 in the X/Y direction. Each package insert 2 has an insertion area, shown shaded at 89 in FIG. 3, in which the depressions 87 (FIG. 5) are distributed; each depression 87 represents one placement position 90. Each placement position 90 is uniquely defined by one X coordinate and one Y coordinate in the coordinate system associated with its package insert 2.

As shown in FIG. 2, the narrow placement means 4, each of which is for instance merely 12 cm wide, are disposed beside one another such that the supply track 80 extends all the way through them, laterally beside the placement head 16 (see also FIG. 4). By an appropriate superimposed control of the positioning motor 60 (FIG. 4), the placement head 16, and hence the associated stop 71 of the supply conveyor belt 66, is shifted in the Y direction in accordance with the Y coordinate of the particular placement position 90 being approached. The placement head 16 of each of the placement means 4, designated a–h, of the insertion station of FIG. 2 thus conveys the articles 1 supplied to it by the supply conveyor belt 66, which as a rule are of different types, on the movement path indicated at 47 in FIG. 4 to the placement position 90 to the Y coordinate of which it has been shifted. This is shown in FIG. 2 by identifying as a–h the depressions 87 of the package insert shown on the right of the drawing.

The disc cams 18 of the placement means 4, which are compulsorily coupled with the drive of the conveyor means 3 via the shaft 56, execute one rotation whenever the supply track 80 in FIG. 2 moves in the conveying direction by the distance of adjacent drivers, i.e. by the carrier spacing T (FIG. 3). This means that the placement head 46 of each suction or gripper element 22 is inserted into the associated package insert 2 after every operating cycle, at an always uniformly set spacing from the following drivers 81, in accordance with the X coordinate of the placement position 90 approached at a given time.

During one rotation of the associated control cam 18, each suction or gripper element is accordingly lowered, from the position shown in FIG. 4, to the article 1 located on the associated stop 71, and then raised together with the article 1, moved away from the stop 71 along the path 47 in a vertical plane extending in the Y direction and into the depression 87, which in the meantime has been brought to the correct position by the synchronized supply track 80, and there released; then the suction or gripper element 22 is returned to the outset position shown in FIG. 4.

The articles are thus deposited into the continuously moving package inserts 2, which are not subjected to any forces of acceleration or retardation at all. The placement means 4 and the conveyor means 3 therefore operate at high speed, and the cam control provided by the disc cams 18 always imparts the same insertion or depositing movement to the insertion arms 21 and the suction or gripper elements 22. A cam control of this kind is sturdy, relatively unsusceptible to malfunction, and wear-resistant, and it can also be kinematically optimized, which makes a high operating speed possible.

As long as the placement means 4 are always placed at the same placement positions 90 to which they have been adjusted, that is, if the pattern or shape of the candy or articles does not vary, no motor-driven shifts in position or similar provisions causing wear are necessary.

If all of the placement means 4, or one of these means, is to approach a different placement position 90, then in order to adjust the X coordinate of the new placement position a supplementary rotational movement is introduced via the positioning motor 58 into the differential gear 50. As a result, the disc cam 18 is additionally rotated relative to the drive shaft 52, which means that the movement phases of the insertion movement executed by the insertion head 46 are temporally phase shifted by a specific, definite length with respect to the movement of the drivers 81. By means of an appropriate selection of the magnitude and direction of the supplementary rotational movement introduced into the differential gear 50 by the positioning motor 58, placement positions 90 having an arbitrary X coordinate can be approached, as shown in FIGS. 2, 3, where the phase shift is marked $\rho$, while $\alpha$ represents a constant factor (gear ratio).

In case the newly approached placement position 90 also necessitates a change of the Y coordinate, this can be accomplished by a simple superimposed control of the positioning motor 60 and the corresponding shift of the entire placement head 16 in the Y direction.

Both the described phase shift for setting the X coordinate and the approach to the Y coordinate of a new, changed placement position 90 can be performed in a freely programmable manner and newly selected for each operating cycle defined by the passage of a package insert 2 or of the associated driver 81 past the placement means 4. The control commands for the positioning motors 58, 60 required to this end can be effected manually, or provided by a program unit or a computer.

Figure 6:
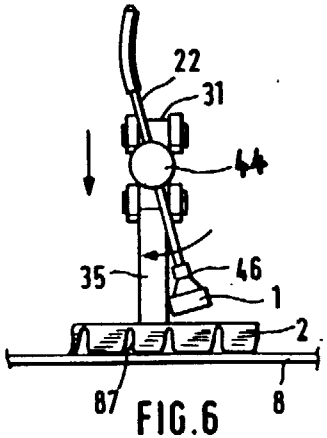
FIGS. 6–8 are fragmentary front views of the gripper elements of the placement means according to FIG. 4, in three different movement situations.
Figure 7:
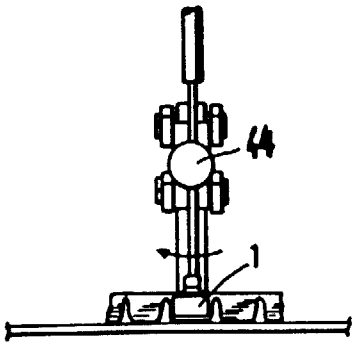
Figure 8:
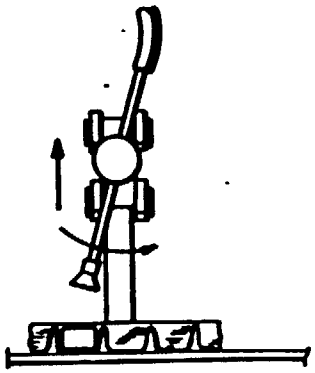

In order to attain an accurate transfer of the articles when they are deposited into the depressions 87 of the package inserts 2, the suction or gripper element 22 of each placement means 4 executes a pivoting movement in synchronism with the conveyor direction 40 as it deposits the article; to this end, the element 22 is pivotably supported about the axis 45 (FIG. 4). For this purpose, the suction or gripper element 22 is imparted a supplementary movement component, at least in the insertion movement phase preceding and following the depositing of the article 1, as will readily be appreciated from FIGS. 6–8. The pivoting of the suction or gripper element 22 about the axis 45 may be motor-controlled or cam-controlled.

The invention explained above in terms of automatically inserting candies into inserts of boxes intended to be sold is naturally not limited to the processing of candy, chocolates or the like; it can be used in any applications in which it is important to deposit articles in an orderly manner onto receiving containers or carriers. Furthermore, the term "article" encompasses groups of articles which are simultaneously transferred to the placement location in an insertion movement.

In the embodiment described herein, the X and Y directions extend at right angles to one another. Embodiments in which they two directions are at angles other than 90° from one another are also conceivable.

I claim:

1. Method of placing small articles (1), such as candies, chocolates and the like, in a predetermined position in a receiver (2) having receiving compartments for the articles, using the steps of allocating to each article a coordinate position (90) in the receiver (2) in an orthogonal X-Y coordinate system (89);

continuously transporting the receiver (2) in the X coordinate direction, with a predetermined speed and a predetermined spacing, beneath an insertion station;

supplying the articles to the insertion station;

at the insertion station, grasping an article and cyclically moving the grasped article in a predetermined insertion path (47) in the Y coordinate direction, over the continuously moving receiver, releasing the grasped article into the receiver (2), and controlling the X coordinate position of placement or the articles in the receiver during the continuous transport movement of the receiver by selectively controlling the timing of the insertion movement of the articles during said continuous transport movement of the receiver with respect to the continuous transport movement of the receiver (2) to thereby determine, during the continuous transport movement of the receiver, the selected X coordinate position (90) of the article (1) in the receiver upon release of the article into the receiver; and the step of cyclically moving the articles in the predetermined insertion path (47) comprises moving the articles in a path which is located in a vertical plane, which plane includes said Y coordinate direction, and is fixed in space; and the receiver is moving at a constant speed past the insertion station.

2. Method according to claim 1 wherein the step of continuously transporting the receiver comprises transporting the receiver (2) at constant speed toward the insertion station.

3. Method according to claim 1 including the step of shifting the entire insertion path in the Y coordinate direction, in dependence on the selected Y coordinate position of the article in the receiver during movement of the receiver.

4. Method according to claim 1 including the step of moving the articles, at least at a time shortly in advance of releasing the article into the receiver with a component of movement corresponding to that of the transport speed of movement of the receiver in the X coordination direction.

5. Apparatus for placement of small articles (1) in predetermined positions in a receiver (2) having receiving compartments for the articles, such as candy or chocolates, in receiving boxes, having an insertion station;

conveyor means (3) continuously moving receivers (2) with predetermined spacing and at a predetermined speed past the insertion station in an X coordinate direction in an X-Y coordinate system, and moving a receiver to receive articles at constant speed past the insertion station, said insertion station including placement means (4);

article holding means (22, 46) and article supply means (5) supplying articles to the holding means;

means (15, 16, 18, 20) for cyclically moving the article holding means in a predetermined insertion path (47) extending in a vertical plane and in the Y direction for placing an article at a predetermined position in the Y coordinate in the receiver (2);

and means (50, 51–54), for synchronously moving the cyclical article holding means and the container means (3), and comprising means for relatively controlling the position of placement of an article being placed in the receiver at a predetermined X-coordinate location during continuous movement of the receiver including means (50, 57, 58) for selectively controlling the relative timing of movement of the article holding moving means (5, 51–54, 3) with respect to the continuous constant speed of movement of the conveyor means (3), and while said receptacle on the conveyor means is moving at said constant speed.

6. Apparatus according to claim 5 wherein the means for controlling the relative timing of movement introduces a temporal phase shift, said timing control means comprising a rotation angle shift coupling between the conveyor means (3) and the article placement means.

7. Apparatus according to claim 6 wherein the rotation angle shift coupling comprises a differential (50);

and shift control means (57, 58) coupled to the differential to introduce a rotational angular shift between an input shaft and an output shaft of the differential.

8. Apparatus according to claim 5 wherein the placement means comprises a placement head (16);

fixed guide tracks (14, 15) controlling movement of the placement head (16) for movement of the placement head in the Y coordinate direction;

and positioning elements (60, 61) coupled to the fixed guide track and moving the fixed guide track (14, 15) in the Y direction to shift the Y position of the insertion of the articles by the insertion head in accordance with a selected Y coordinate of the selected position.

9. Apparatus according to claim 8 wherein the positioning head comprises a gripper element (22) and a cam-control linkage (20) moving said gripper element along said predetermined insertion path (47) in a vertical plane, extending in the Y coordinate direction.

10. Apparatus according to claim 9 wherein the placement means comprises a narrow placement unit having a width less than the length of a receiver (2);

and wherein said apparatus comprises a plurality of said placement units located adjacent each other.

11. Apparatus according to claim 8 including means for conjointly adjusting the position of the insertion head and the article supply means (5).

12. Apparatus according to claim 11 wherein the article supply means comprises a supply conveyor (66) serially supplying the article to a receiving position (71) having a fixed positional relationship with respect to said insertion path (47).

13. Apparatus according to claim 5 wherein said receiver conveyor (3) comprises a smooth supply track (80);

a movement control belt (82) located at least on one side of the supply track (80) and including driver elements (81') located thereon and engageable with the receivers (2), said movement control belt having a run extending parallel to the supply track, the movement of the movement control belt being synchronized with the placement means (4), and operating at a speed which is different from the surface speed of the supply track (80).

14. Apparatus according to claim 13 wherein said supply track comprises a supply belt which is driven at a speed below the speed of the movement control belt (82).

15. Apparatus according to claim 13 wherein the run of the movement control belt (82) facing the receivers (2) is adjustable in the direction of the Y axis.

16. Apparatus according to claim 13 wherein the receivers (2) comprise deep drawn depressions (87) adapted to receive candy or cholocates;

and the drivers (81, 81') are located at approximately the level of the deformed, deep drawn depressions (87).

17. Apparatus according to claim 5 wherein the article holding means comprises gripper means;

said gripper means having a portion engaging the articles (1) which portion is moveable in the first coordinate direction (X) to permit placement of the articles in the receiver with a component of movement corresponding to the movement of the receiver in said first coordinate direction.

* * * * *